United States Patent [19]

Steiner

[11] 3,976,105

[45] Aug. 24, 1976

[54] DEVICE FOR FILLING YARN BOBBINS ON THE SHUTTLES OF A TRAVELING WAVE LOOM

[75] Inventor: Alois Steiner, Rieden, Switzerland

[73] Assignee: Ruti Machinery Works Ltd., Ruti, Switzerland

[22] Filed: Apr. 1, 1975

[21] Appl. No.: 564,035

[30] Foreign Application Priority Data

Apr. 24, 1974 Switzerland ..... 5637/74

[52] U.S. Cl. ..... 139/436; 139/224 R

[51] Int. Cl.[2] ..... D03D 47/26; D03D 45/00

[58] Field of Search ..... 139/12, 224 R, 224 A, 139/122 W, 125, 197

[56] References Cited

UNITED STATES PATENTS

| | | | |
|---|---|---|---|
| 2,042,703 | 6/1936 | Dreyfus et al. | 139/224 R |
| 3,379,224 | 4/1968 | Pend et al. | 139/224 R |
| 3,724,508 | 4/1973 | Jekl et al. | 139/12 |
| 3,732,896 | 5/1973 | Jekl et al. | 139/12 |
| 3,835,893 | 9/1974 | Galperin et al. | 139/12 |

FOREIGN PATENTS OR APPLICATIONS

| | | | |
|---|---|---|---|
| 2,118,445 | 11/1971 | Germany | 139/12 |
| 157,292 | 7/1962 | U.S.S.R. | 139/224 R |

*Primary Examiner*—James Kee Chi

*Attorney, Agent, or Firm*—Donald D. Denton

[57] ABSTRACT

A device for the filling of filling yarn bobbins on the shuttles of a traveling wave loom which has continuously rotating a conveying chain to move the shuttles having empty bobins thereon from the outlet edge to the inlet edge of the fabric during weaving, the shuttles being guided between slide rails with each bobbin provided with a small toothed wheel that meshes with a large toothed wheel to bring about the rotation of the bobbin for winding thereon a filling yarn.

13 Claims, 9 Drawing Figures

DEVICE FOR FILLING YARN BOBBINS ON THE SHUTTLES OF A TRAVELING WAVE LOOM

BACKGROUND OF THE INVENTION

The present invention relates to a device for the filling of filling yarn bobbins on the shuttles of a traveling wave loom or shaft shed weaving machine which comprises continuously rotating a conveying chain to move shuttles having empty bobbins thereon from the outlet edge to the inlet edge of the fabric during the weaving process, the shuttles being guided between slide rails with each bobbin on the shuttle provided with a small toothed wheel that meshes with a large toothed wheel member to bring about the rotation of the bobbin for winding thereon a filling yarn supplied.

In shaft shed weaving machines, wherein as is known a plurality of shuttles are successively and uniformly distributed over the entire fabric width and are conveyed at continuous speed through the shed and are then transported back empty from the outlet edge to the inlet edge of the fabric, the filling of the filling yarn bobbins on the shuttles represents a considerable problem.

For example, a shaft shed weaving machine of the above type is known wherein the toothed member for rotating the filling yarn bobbins of the shuttles is a rack which extends approximately over the entire machine width, parallel to which the winding members from which the filling yarns are removed are moved at the running speed of the shuttles in order to fill the shuttle bobbins during this parallel movement (DOS 2,207,248).

The object of this construction is to supply as many shuttle bobbins as possible with an adequate length of filling yarn during one rotation.

This problem is solved with another known construction of a shaft shed weaving machine in that the shuttles rotate on the circumference of transporting wheels whereby the latter carry the reserve winding members (Australian Pat. No. 240,564).

However, both these constructions have the disadvantage of requiring a great deal of space, quite apart from the technical expenditure required in concomitantly moving the large mass of the reserve winding members. A further disadvantage is that the length of the filling yarn which can be wound onto the bobbin of each shuttle can scarcely be varied which excludes any change to the fabric width.

SUMMARY OF THE INVENTION

The present invention therefore provides a device of the type indicated hereinbefore on a shaft shed weaving machine that permits the filling of filling yarn bobbins on the shuttles within only a small portion of their movement path from fixed reserve winding members, whereby the length of the filling yarn to be wound can be randomly varied.

According to the invention, the problem heretofore described is solved in that a toothed member is formed by a toothed wheel of a gear arranged in front of the inlet edge of the fabric, and around the said gear extend a conveying chain and slide rails for the shuttles which can be driven at variable speed relative to the conveying chain, whereby the apparatus for supplying filling yarns to the shuttle bobbins is arranged on the inlet side in front of the engagement point of the shuttle bobbins in the toothed wheel.

These arrangements make it possible to arrange the device for filling the filling yarn bobbins of the shuttles on the filling yarn insertion side of the shaft shed weaving machine which considerably increases the accessibility of the machine over the width thereof. In addition, the zone within which the shuttle bobbins must be in engagement with the toothed member or wheel to bring about the rotation thereof for winding on the yarn is reduced to a minimum because this zone no longer alone determines the number of rotations and therefore the length of the wound-on filling yarn, in that relative to the shuttle rotation direction, the gear can now be counter-rotated at random speed which correspondingly increases the winding speed of the shuttle bobbins.

However, in the case of very narrow fabric widths, the gear can also be rotated in the shuttle rotation direction so that the shuttle bobbins undergo retarded rotation and therefore only wind-on a limited filling yarn length.

According to an advantageous embodiment of this device, the apparatus for supplying the filling yarns to the shuttle bobbins can be provided with a number of yarn guides corresponding to the number of shuttles simultaneously engaging on the toothed wheel of the gear, whereby the said yarn guides are pivotally mounted independently of one another and superimposed in different planes between a working, a waiting, and a winding position. Thus each of the yarn guides is in working connection with a fixed reserve winding member and the construction can be such that the yarn guides are in the form of tubes which, in the working and waiting position, issue into the area of yarn guidance plates which form yarn guidance grooves being inclined towards the inlet edge of the fabric.

These measures prevent any entanglement of the filling yarn which up to the complete insertion in the shed are still connected with the particular reserve winding members because each individual filling of the shuttles moved simultaneously in the area of the device remains strictly in its movement plane defined by the particular yarn guide and particular yarn guidance groove.

To ensure that the particular shuttle and the conveying chain are separate from one another when the individual shuttle penetrates the fabric shed, the conveying plane formed by the leading and following strands of the conveying chain can form an angle with the weaving plane in such a way that the conveying chain is lowered beneath the fabric.

BRIEF DESCRIPTION OF THE DRAWINGS

Other and further objects of the present invention will be apparent from the following description and claims and are illustrated in the accompanying drawings which by way of illustration show preferred embodiments of the present invention and the principles thereof and what are now considered to be the best modes contemplated for applying these principles. In the drawings:

DESCRIPTION OF PREFERRED EMBODIMENTS

Figure 1:
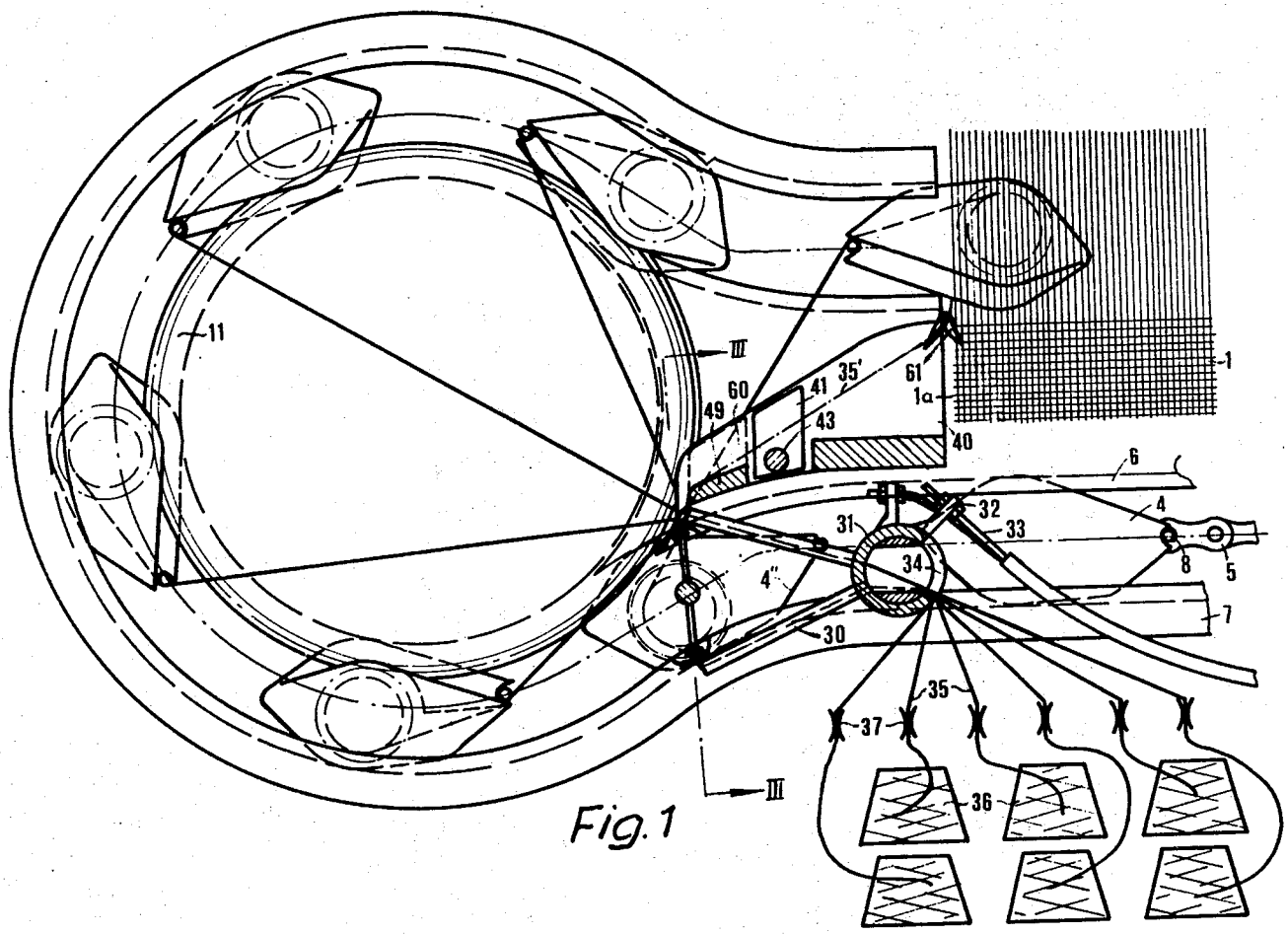
FIG. 1 is a plan view of the device according to the invention shown schematically.
Figure 2:
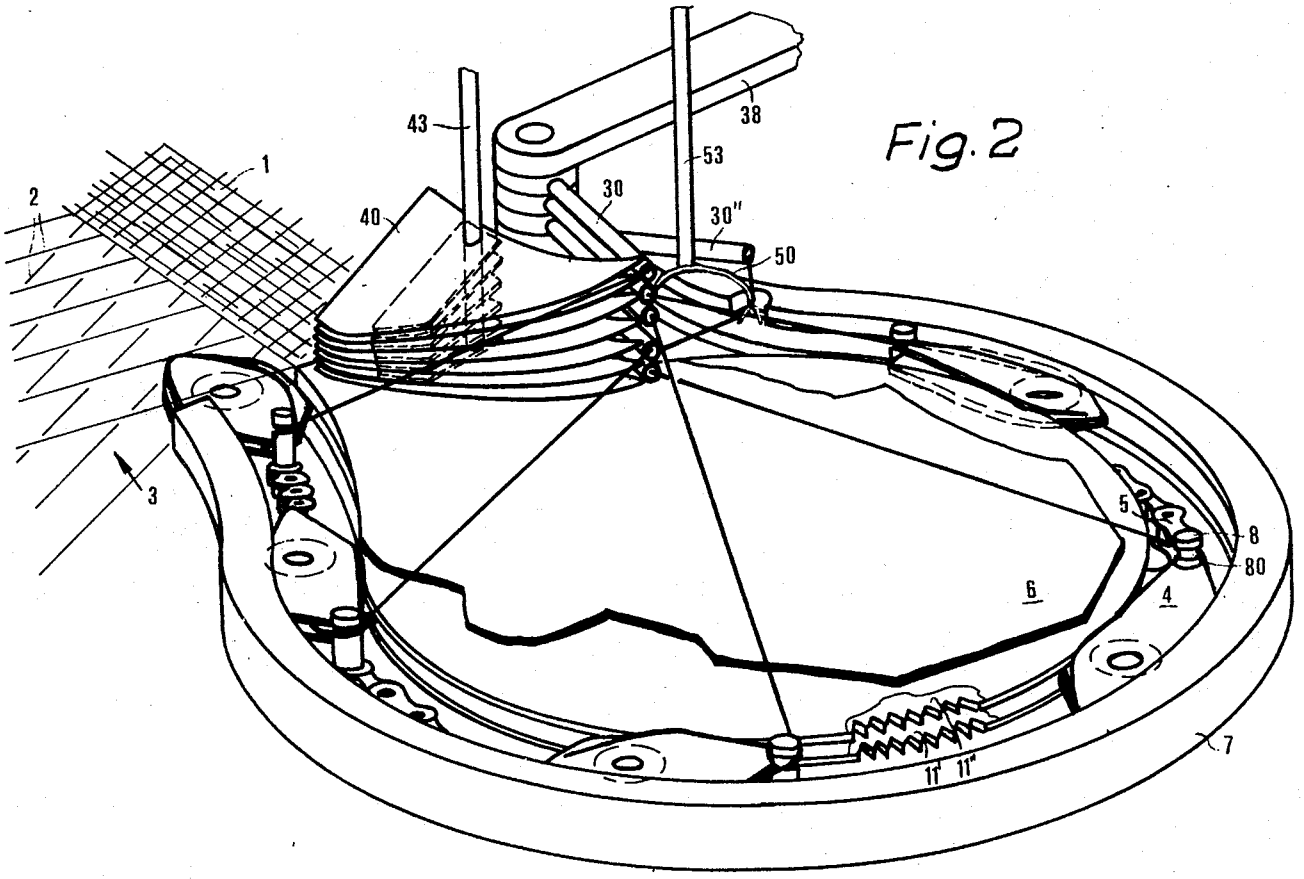
FIG. 2 is a perspective view of the device illustrated in FIG. 1 viewed from another direction.
Figure 3:
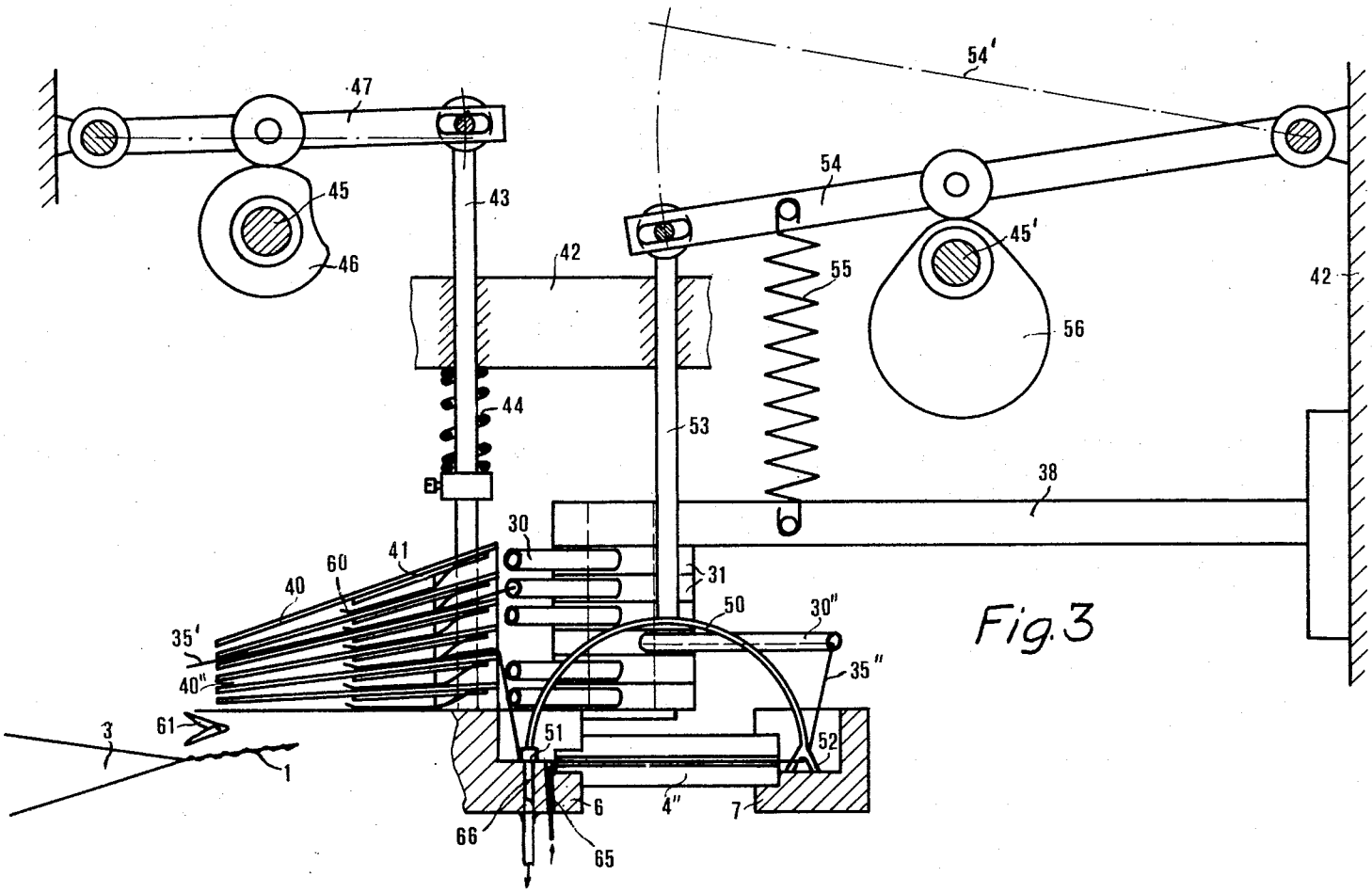
FIG. 3 is a vertical view of a section taken along the line III—III of FIG. 1 and presented on a larger scale.

In the device for filling the filling yarn bobbins of shuttles on a shaft shed weaving machine shown in FIGS. 1 to 3, the latter is only indicated by a cutaway portion of a fabric 1 with the so-called inlet edge 1*a* made on this machine. In conventional manner, the machine forms a shed 3 from the warp yarns 2 and then from the inlet side of the fabric 1*a* the shuttles are moved through this shed by a shuttle conveying means not shown. The present invention relates solely to the filling of the empty shuttles on leaving the shed on their return travel and prior to their reinsertion in the shed, so that the following description is limited to the mechanism on a shaft shed weaving machine that will accomplish this.

Figure 4:
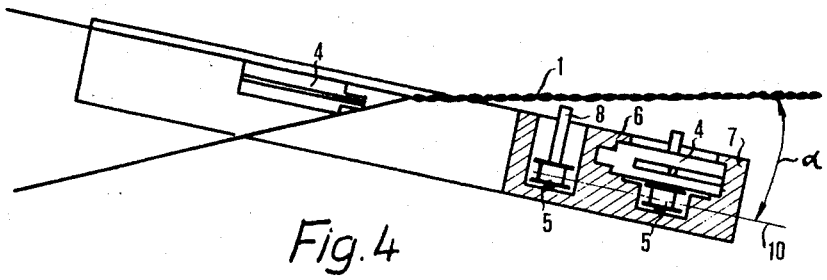
FIG. 4 is a side view in section showing the relative positions of the weaving and conveying planes of the device.

In per se known manner, the empty conveying of shuttles 4 from the outlet edge 1*b* to the inlet edge 1*a* of the fabric 1 takes place by means of a continuously rotating conveyor chain 5 which moves the shuttles 4 between slide or guide rails 6 and 7 which can form a displacement channel in the direction of the fabric inlet edge substantially along a straight path extending over the entire machine width. To this end individual chain links carry upwardly projecting follower pins 8 which can engage in a corresponding recess in each shuttle box, thus moving the shuttles before them, as can be seen in particular in FIG. 2. FIGS. 1 and 2 also clearly show that the channel in the area of the inlet edge 1*a* of fabric 1, i.e. substantially on one machine side, passes into a substantially circular path and then issues immediately in front of the inlet edge 1*a* of the fabric. FIG. 4 shows that the conveying plane 10, which is formed by the strands of chain 5 and the weaving plane indicated by fabric 1, forms an angle $\alpha$ in such a way that, with the insertion of the incoming filled shuttle 4 into the shed and its taking over the not shown further conveying means, conveying chain 5 is lowered to such an extent relative to the weaving plane that follower pin 8 also passes underneath the fabric (see FIG. 4).

The circular portion of the channel surrounds a gear or gear toothed member 11 which, as shown in FIG. 2, here comprises two axially spaced ratchet wheels 11′ and 11″ which project into the inner slide rail 6 to such an extent that they can engage in ratchet or toothed wheels 19 and 20 on the bobbin 18 of the particular rotating shuttle 4 as will be explained in detail hereinafter. Gear 11 is movable relative to conveying chain 5 via appropriate drive means with variable speed and drivable in one or another rotational direction.

Figure 6:
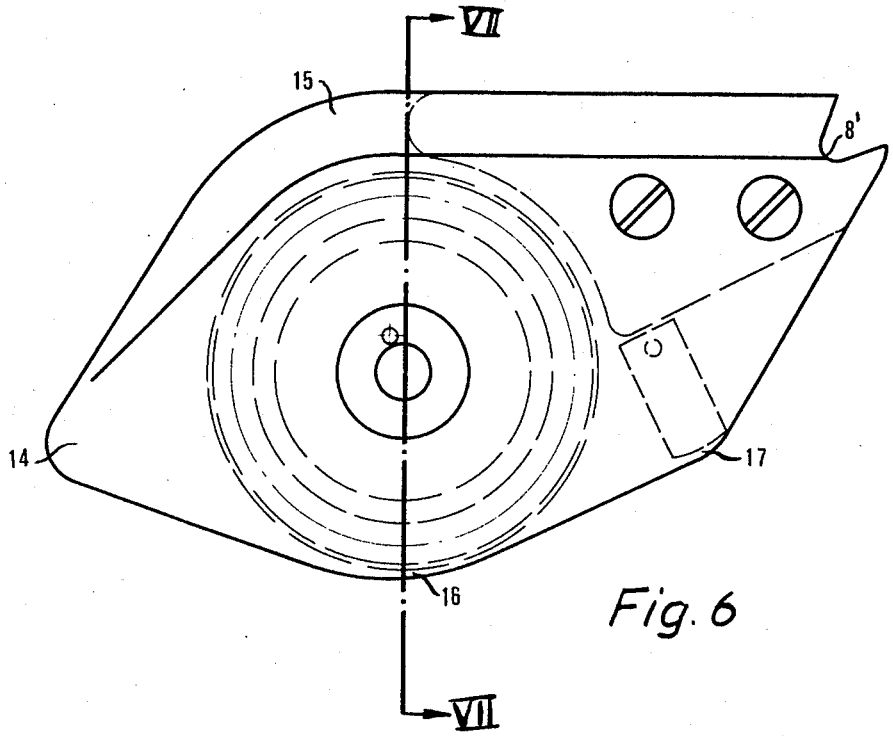
FIG. 6 is a plan view of a shuttle and FIG. 7 is a cross-sectional view taken along the line VII—VII of the shuttle in FIG. 6 showing the shuttle bobbin.
Figure 7:
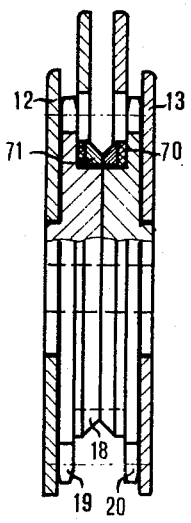

To illustrate clearly the cooperation between a shuttle moved into and through the curved path by the conveying chain 5 and the gear 11, reference should be made to FIGS. 6 and 7 showing an embodiment of such a shuttle. This shuttle 4 is flat in cross-section and has an upper plate 12 and a lower plate 13 of identical outer contours. These outer contours show a fish-shaped configuration, whereby the end of shuttle 4 is formed by the already mentioned recess 8′ for the engagement of follower pin 8. To enable the shuttle to follow the relatively narrow circular path without jamming between its guide rails 6 and 7, circular sector-shaped transitions 15, 16 and 17 are provided on the contours from tip 14 to end 8′ which simultaneously provide a three-point support of shuttle 4 in its displacement channel provided by slide rails 6, 7. The filling yarn bobbin 18 is mounted in freely rotatable manner between plates 12 and 13 and is connected at top and bottom with ratchet wheels 19 and 20 which serve to mesh with ratchet wheels 11′ and 11″, respectively.

If during its empty conveying from one side of the machine to the other shuttle 4 enters the circular path area, gear 11 can engage on ratchet wheels 19 and 20 of bobbin 18 of shuttle 4, whereby bobbin 18 is rotated as a result of the relative movement between gear 11 and shuttle 4.

This rotation of bobbin 18 serves for the winding-on of a filling yarn, which during the subsequent movement of shuttle 4 through the shed of fabric 1 is inserted in the fabric. For this purpose, an apparatus for supplying filling yarns to the shuttle bobbins is provided on the inlet side in front of the engagement point of shuttle bobbin 18 in the toothed wheel of gear 11.

Figure 5:
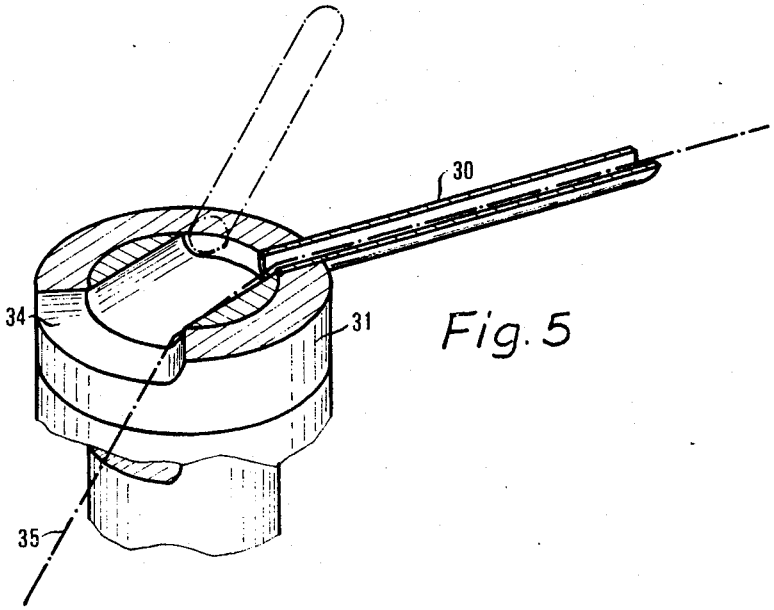
FIG. 5 is a view in perspective of a detail of the arrangement shown in FIG. 1 presented on a larger scale.

As shown in FIGS. 1 to 3, this apparatus comprises a plurality of yarn guides 30 which are pivotally mounted independently of one another and superimposed in different planes between a working and waiting position and a winding position. The number of yarn guides 30, in the present case six, corresponds to the number of shuttles 4 which are simultaneously located in the zone between the intake point of shuttles 4 into the circular path and the outlet point in the area of the fabric edge. Each of the yarn guides 30 is supported with one end in a disc 31, i.e. one end in one disc in each case, whereby the independently rotatable discs 31 are stacked upon one another in tower-like manner as can be seen particularly in FIG. 3. An adjusting mechanism 33 engages on a flange 32 of each disc 31. As particularly shown in FIG. 1, each disc 31 and therefore each yarn guide 30 can move into its one or other extreme position. A disc 31 with the appropriate yarn guide 30 is shown on an enlarged scale in FIG. 5 which also shows an elongated slot 34 which as will be explained hereinafter permits an inserted filling yarn 35 to assume different angular positions relative to the axial intake of the here tubular yarn guide 30. The discs 31 are jointly supported on a carrier 38 fixed to machine frame 42 (see FIG. 3).

FIG. 1 shows that filling yarn is supplied to each yarn guide 30 from a corresponding number of reserve winding members or means 36, whereby the winding members are fixed at an appropriate point on the machine by means of corresponding holding means and a yarn brake 37 is provided between the particular reserve winding member 36 and the yarn guide 30. Thus, in any operating phase, the particular filling yarn 35 extends from its reserve winding member 36 via yarn brake 37 through slot 34 of ring flange 31 and out through the front opening of the yarn guide tube 30.

As can be seen, the pivot range of the yarn guide tube opening is such that in the working and waiting position it is located on the inside in the circular path approximately over the transition area of the shuttles and for reaching the winding position is movable outwards over approximately the width of the displacement channel provided by slide rails 6, 7.

In the working and waiting position of the yarn guide tubes 30, yarn guidance plates 40 inclined towards the outer edge of fabric 1 are connected to the openings thereof, whereby the said plates define a separate guidance channel for each filling yarn. In each of these guidance channels is provided a clamping member 41 movable between two positions which acts as a yarn brake means with the lower guidance plate 40 in the clamping position.

The clamping members 41 are jointly adjustable via a control rod 43 supported on machine frame 42. The control rod is here controlled by the action of a control spring 44 and is operable via a pivotable lever 47 by means of a cam 46 which rotates with the machine control shaft 45, as well be explained hereinafter (see FIG. 3).

As shown in FIGS. 1 to 3, the apparatus for supplying filling yarns to the shuttle bobbins comprises a so-called yarn feeder. The yarn feeder comprises a bow-shaped member 50 extending in the imaginary connecting line between the openings of yarn guide tubes 30 in the two extreme positions thereof. At each end 51 or 52 of the bow-shaped member is provided a holding member for a yarn in such a way that a yarn held taut between holding members 51 and 52 in a lower extreme position of bow-shaped member 50 extends at right angles over the displacement channel for shuttles 4 at a height where, from the tip 14 of the incoming shuttle 4, the yarn can enter the same and encounter bobbin 18. From the said lower extreme position which represents the threading position, bow-shaped member 50 can be set in an upper extreme position for which purpose member 50 is fixed to a control rod 53 which is guided in adjustable manner on machine frame 42. On control rod 53 engages a control lever 54 which is under the action of a restoring spring 55 and which works on guidance plates 40 synchronously with the lever drive represented by numerals 43, 46 and 47 for clamping members 41. To this end, a further cam 56 is provided which is mounted on machine shaft 45'.

Before the above-described device starts operating, the yarn ends are drawn from the filling yarn reserve winding members or means 36 over the appropriate yarn brake 37 through the guidance slot 34 of disc 31 and the appropriate yarn guide tube 30 then being placed in the associated yarn guidance channel between the yarn guidance plates 40 under the substantially unstressed clamping member 41. The yarn end terminates appoximately with the edge of the stack of yarn guidance plates 40 adjacent to the fabric edge as can be seen in FIG. 3 relative to the second from top filling yarn 35. Naturally, all the yarn guidance tubes 30 are in the working and waiting position and each filling yarn has approximately the same course as filling yarn 35' shown in FIG. 1. For the slight deflection of the filling yarn 35 from the direction given by the yarn guidance tube 30 in the direction towards the fabric edge 1*a*, a deflector 49 is appropriately provided in each yarn guidance channel defined by plates 40, as can be gathered from FIG. 1. The deflecting edge of deflector 49 extends close to the opening of the particular yarn guidance tube 30.

In this position for initiating operating of the device, the control rod 43 is located in the upper extreme position of FIG. 3 in which the clamping members 41 are substantially unstressed. Furthermore, the control rod 53 together with the yarn feeder bow 50 are in an upper extreme position indicated by the dotted line 54' in FIG. 3. In this position, the yarn holding members 51 and 52 of bow-shaped member 50 are located above the pivot plane of the uppermost yarn guidance tube 30.

As already stated, when the shaft shed weaving machine is operated the conveying chain 5 continuously rotates at a conveying speed for the shuttle which is concomitantly moved corresponding to the insertion speed of shuttle 4 into the shed. The setting of one of the yarn guidance tubes 30 in its winding position takes place immediately before a shuttle 4, which has been conveyed empty to the filling device, enters the circular path of displacement channel formed by slide rails 6, 7. Depending on the position of a not shown timing means relative to the operation of the setting means 33 for yarn guides 30 to take place successively, the fourth yarn guide 30'' can for example be placed from above in its winding position (see FIG. 3). Since the particular filling yarn 35'' is subject to more pronounced braking on the removal side by yarn brake 37 than by the unstressed clamping member 41 in the corresponding yarn guidance channel 40'', its end is moved out of the yarn guidance channel 40'' but only to the extent that the end remains in the area of a preclamping spring 60 on clamping member 41. This has the advantage of shortening this free yarn end prior to winding on. Naturally, it would also be possible to secure the yarn end prior to the pivotal movement of yarn guide 30''. In this case, securing takes place immediately after pivoting the yarn guide 30'' into its winding position through lowering control rod 43 so that clamping member 41 clamps the filling yarn against the lower plate 40 of yarn guidance channel 40''. This clamping force is greater than the braking force of yarn brake 37 (see FIG. 1). In this clamping phase, the control rod 53 together with the yarn feeder bow 50 is brought into the lower extreme position shown in FIG. 3 whereby the holding members 51 and 52 on bow-shaped member 50 grip the yarn 35'' which is at right angles to the displacement channel and press it into the insertion plane of the arriving shuttle 4''. A certain amount of filling yarn is thereby removed from the particular reserve winding member 36. Immediately thereafter, the control rod 43 is again moved upwards and the clamping action on the yarn end in yarn guidance channel 40'' is only exerted by spring 60. FIG. 2 also shows this readiness position of the yarn to be wound.

After making ready filling yarn 35'', this can penetrate from the tip 14 of the arriving shuttle 4'' between the plates 12 and 13 thereof (see FIGS. 6 and 7). Yarn 35'' is then held by securing means on bobbin 18 whereby simultaneously bobbin 18 or its toothed wheels 19 and 20 engage with gear 11 so the bobbin 18 starts to rotate. Substantially simultaneously with the winding on, the yarn feeder bow 50 is returned to its upper extreme position and yarn guide 30'' is pivoted back into its working and waiting position. The now rotating bobbin 18 of shuttle 4'' on the one hand pulls the end of the filling yarn from yarn guidance channel 40'' and on the draws yarns from the particular reserve winding member 36, corresponding to its speed, and winds these latter yarns on during the further conveying of the shuttle to the intake edge 1*a* of fabric 1. As the conveying speed of shuttle 4'' is also constant in this zone, by giving a counter rotation to gear 11 in a counter-clockwise direction with regulatable speed, the speed of bobbin 18 of shuttle 4'' can be randomly increased so that the length of the filling yarn wound-on can randoming vary and be adapted to any fabric width.

As a result of the above indicated setting of yarn guide tube 30'', the particular shuttle 4'' has been moved back to such an extent that yarn guide 30'' during its pivotal movement can place the yarn strand between bobbin 18 and the opening of yarn guide 30'' in a guidance slot 80 on the top of the particular follower pin 8 of the conveying chain 5. FIG. 2 clearly shows that this guidance slot 80 and the opening of the particular yarn guide 30 then form deflection points for the wound yarn which remains stretched between these points. Since as already stated, the yarn guide tubes 30 are now superimposed, the arrangement makes it impossible that the yarn strands can in any way become entangled during their rotary movement between the individual tubes 30 and the associated follower pins 8 on chain 5.

After winding, which as taken place in the above described manner, the particular shuttle 4'' continues its movement in the direction of the intake edge of the fabric. The shuttles 4 follow at an appropriate given spacing which together with the conveying speed for the shuttles determines the cycle in which the above-described winding process is repeated for the next shuttle, naturally using the next yarn guide tube 30.

The final phase of the above-described winding process and the beginning of insertion of the filled shuttle into the shed 3 are illustrated particularly in FIGS. 1 and 2. Prior to the insertion of the shuttle in the shed, as a result of appropriate shaping of displacement channel 6, 7 in this area, the driving connection between the bobbin 18 of the particular shuttle and gear 11 is interrupted which stops the winding process. In this phase the free yarn penetates between follower pin 8 and yarn guide 30 into the corresponding guidance channel between the yarn guidance plates 40 and moves underneath the pre-clamping spring 60 on clamping member 41. With the penetration of shuttle 4 into shed 3, the conveying chain 5 together with the follower pin 8 passes under fabric 1, as described in FIG. 4, and the further conveying of shuttle 4 through the shed is performed by means not shown on the shaft shed waving machine. The yarn is thereby released from the guidance slot 80 of follower pin 8 and is located in its guidance channel as indicated by yarns 35' in FIG. 1. The yarn remains stretched in this position for as long as the filling yarn end must be held for filling purposes. Cutting devices 61 then cuts off yarn 35' in the area of the fabric edge leading once again to the starting position for a new winding process.

As already stated, bobbin 18 of shuttle 4 has gripping means for taking up the supplied filling yarn in order to be able to wind the latter on bobbin 18. In the case of the bobbin 18 shown in FIG. 7, these gripping means comprise disc-like clamping jaws 71 supported towards the outside on elastic discs 70. The said jaws open under the pressure of the arriving yarn and delimit a radial slot in the center of bobbin 18. The arrangement is such that the depth of this slot only corresponds to about the thickness of the yarn to be wound on, which prevents several yarn turns being secured.

Figure 8:
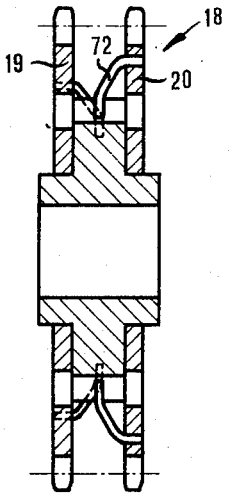
FIG. 8 is a cross-sectional view and FIG. 9 is a plan view of a variant of a shuttle bobbin.
Figure 9:
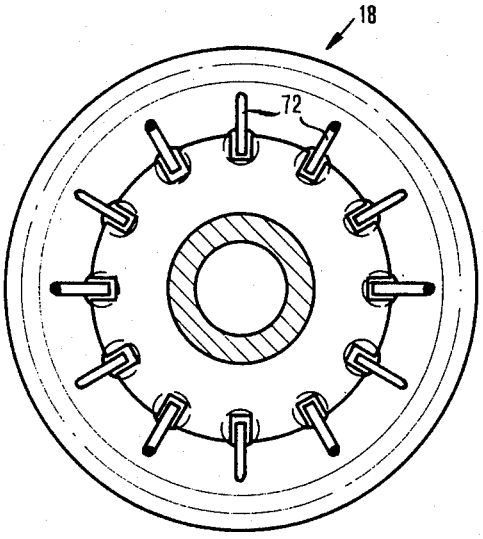

In the embodiment of such a bobbin 18 shown in FIGS. 8 and 9 inwardly directed elastic clamping pins 72 project from the two ratchet wheels 19 and 20 of bobbin 18. The free ends of each of these clamping pins 72 extend up to the face of the yarn package in the center of the bobbin and are uniformly distributed and reciprocally staggered over the entire periphery of the bobbin. If the taut yarn passes between clamping pins 72, they are pressed somewhat outwards thereby securing the yarn. If the tension in the yarn decreases, the clamping pins 72 return to their initial position and the yarn is then only held by the looping friction.

If during winding the free yarn end is to be as short as possible, each shuttle 4 can also be equipped with a knife which cuts off the yarn during its taking up and winding in the area of holding member 51. However, this knife can also be arranged adjacent to holding member 51 at point 65 of slide rail 6 (see FIG. 3). In both cases, it is then advantageous to provide at this point a suction channel 66 which can be connected with a vacuum pipe for sucking off the residual yarn.

While there have been described and illustrated the preferred embodiments of the invention, it is to be understood that other variations and modifications can be made and therefore the invention herein is not to be limited to the precise details set forth above but to include such modifications and alterations as fall within the scope of the appended claims.

What is claimed is:

1. A device for the filling of the filling yarn bobbins on shuttles of a traveling wave loom, which comprises a continuously rotating conveying chain means for moving shuttles having empty bobbins from the outlet edge of the fabric being woven to the inlet edge thereof, said shuttles being guided between slide rails, said bobbins being provided with a toothed wheel that meshes with a circular gear toothed member to bring about the rotation of the bobbins as the shuttles are conveyed around said gear toothed member for winding onto each of said bobbins a supply of filling yarn, said conveying chain means and said slide rails for the shuttles extending around said gear toothed member which can be rotated at variable speed relative to the speed of said conveying chain means and said shuttles, wherein the means for supplying the filling yarns to the bobbins stationarily arranged on the side of said slide rails.

2. A device according to claim 1 wherein the means for supplying the filling yarns to the bobbins is provided by a number of yarn guides corresponding to a number of shuttles that are in simultaneous engagement with the toothed gear member and the yarn guides are pivotally mounted between a working and waiting position and a winding position independently of one another and superimposed in different planes, whereby each of the said yarn guides is operatively connected with a fixed reserve winding member.

3. A device according to claim 2 in which each of the yarn guides is in the form of a tube issuing in the working and waiting position in the area of yarn guidance plates which form yarn guidance channels and which converge towards the inlet edge of the fabric.

4. A device according to claim 3 wherein a controllable yarn brake is provided in each of the yarn guidance channels.

5. A device according to claim 3 wherein a yarn feeder is provided with a lowerable yarn feeder bow passing in an imaginary connecting line between the openings of the yarn guide tubes in their two extreme positions.

6. A device according to claim 5, wherein yarn holding members are provided at the two bow ends to hold a yarn taut between the holding members, which yarn extends at right angles to the displacement channel of the shuttle in a lower extreme position of the bow-shaped member.

7. A device according to claim 1 wherein the conveying plane formed from the leading and following strands of the conveying chain means forms an angle with the weaving plane.

8. A device according to claim 1 wherein the conveying chain means has spaced follower pins which cooperate with a receiving slot on the shuttles for the displacement thereof in a displacement channel formed by the slide rails.

9. A device according to claim 8 wherein the follower pins have an annular slot on the free ends thereof for deflecting the wound yarn to the particular yarn guide.

10. A device according to claim 1 wherein each shuttle comprises a body carrying the bobbin in freely rotatable manner which has lateral guidance surface with circular section-shaped portions for sliding engagement on the slide rails.

11. A device according to claim 10 wherein each bobbin is defined by toothed wheels having in its center a yarn gripping means.

12. A device according to claim 11 wherein the yarn gripping means comprise disc-like clamping jaws supported towards the outside against elastic discs.

13. A device according to claim 11 wherein the yarn gripping means are clamping pins directed inwardly towards the face of yarn package produced by the winding of yarn onto the bobbins, which pins are reciprocally staggered and uniformly distributed over the entire periphery.

* * * * *